United States Patent [19]

Leonard

[11] Patent Number: 4,463,509

[45] Date of Patent: Aug. 7, 1984

[54] VIBRATORY PLOW ASSEMBLY

[75] Inventor: Emil T. Leonard, Wichita, Kans.

[73] Assignee: J.I. Case Company, Racine, Wis.

[21] Appl. No.: 474,393

[22] Filed: Mar. 11, 1983

[51] Int. Cl.[3] ..... E02F 5/18

[52] U.S. Cl. ..... 37/193; 37/98; 37/DIG. 18; 172/40; 172/699; 404/90; 405/182

[58] Field of Search ..... 37/98, DIG. 18, 193; 172/40, 699, 413, 477; 405/174, 182, 183; 404/90

[56] References Cited

U.S. PATENT DOCUMENTS

| | | | |
|---|---|---|---|
| 3,363,423 | 1/1968 | Davis | 172/40 X |
| 3,613,799 | 10/1971 | Bodine | 37/DIG. 18 X |
| 3,618,237 | 11/1971 | Davis | 37/98 |
| 3,638,339 | 2/1972 | Vik | 37/98 |
| 4,102,403 | 7/1978 | Steinberg | 37/DIG. 18 X |
| 4,164,982 | 8/1979 | Draney | 37/DIG. 18 X |
| 4,200,410 | 4/1980 | Baker et al. | 37/193 X |
| 4,229,045 | 10/1980 | Gurries | 37/DIG. 18 X |
| 4,252,376 | 2/1981 | Gurries | 37/DIG. 18 X |
| 4,377,914 | 3/1983 | Draney et al. | 37/193 |

*Primary Examiner*—Edgar S. Burr
*Assistant Examiner*—Moshe I. Cohen
*Attorney, Agent, or Firm*—Cullen, Sloman, Cantor, Grauer, Scott & Rutherford

[57] ABSTRACT

A vibratory plow assembly which eliminates the need for elastic torque cushioning elements. The plow assembly includes a vertically extending support frame and a vertically extending shaker frame having an elongated plow blade attached thereto with an oscillating mechanism supported on the shaker frame for reciprocating the shaker frame and plow blade. The support and shaker frames are interconnected adjacent their upper ends by conventional connecting links. The lower ends of the support and shaker frames are interconnected by a generally planar, horizontally disposed, spring plate member which is fixedly attached to the support frame at one end and is secured to the bottom of the shaker frame at its opposite end. The spring plate member withstands the loading imposed upon it by the shaker frame and plow blade while being flexible to deflect vertically thereby permitting the vibratory motion from the oscillating mechanism to be transmitted to the plow blade. Further, the vibratory movement imparted to the shaker frame by the oscillating mechanism is also transmitted to the spring plate member which results in a reinforcement or prolongation of the vibratory movement imparted to the plow blade.

2 Claims, 4 Drawing Figures

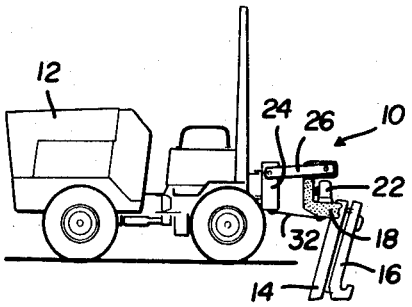
FIG. 1
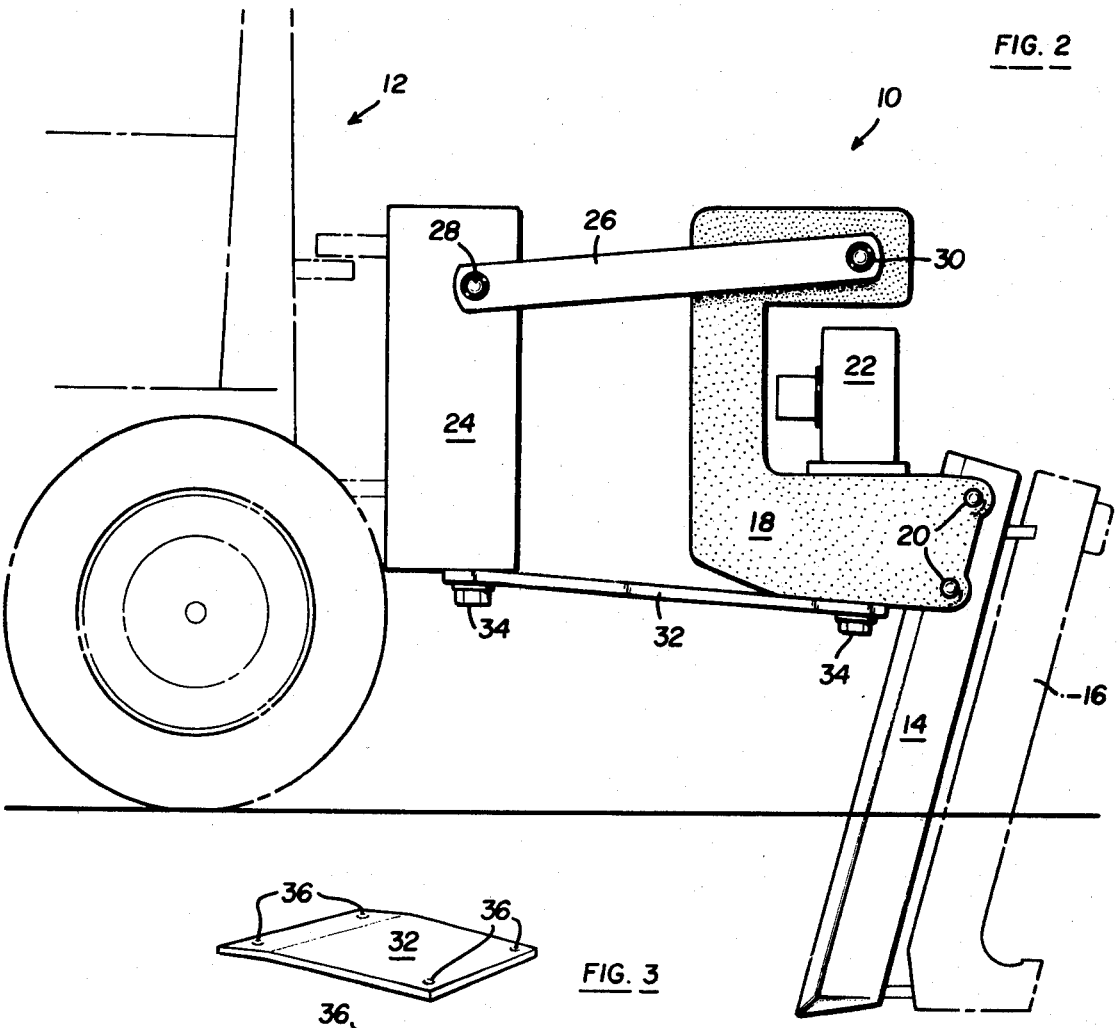
FIG. 2
FIG. 3
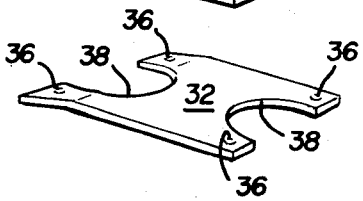
FIG. 4

VIBRATORY PLOW ASSEMBLY

BACKGROUND OF THE INVENTION

Plows of the type disclosed herein having an elongated vertical blade have been utilized for several years to lay cable, flexible pipe, etc. The cable or pipe may either be pulled through the cut of the plow blade or a cable chute may be provided on the trailing edge of the blade which guides the cable into the ground from a drum mounted on the prime mover. More recently, various types of vibrators have been mounted on the plow blade or the supporting frame which effectively reduces the drawbar pull or force required to pull the blade through the ground, such as disclosed in U.S. Pat. No. 3,363,423. Vibration of the blade of a cable laying plow results in several advantages including less ground disturbance, faster cable laying installation, etc.

Following the development of vibratory cable laying plows, several improvements have been made, particularly relating to isolation of the vibrating blade. For example, U.S. Pat. No. 3,618,237 discloses a frame support for a cable laying plow having torque cushioning elements which absorb the reciprocable motion of the support and substantially isolate the frame from the supporting structure. While it is desirable that the vibrator be isolated from the tractor or prime mover, these torque cushioning elements add significantly to the expense and complexity of the frame support.

The vibratory cable plow suspension of the present invention provides a relatively simple and inexpensive support for the vibratory blade and eliminates the requirement for torque cushioning elements to isolate the vibrator from the prime mover.

SUMMARY OF THE INVENTION

The vibratory cable laying assembly of the present invention includes a flat, elongated blade having a vertical ground slitting edge at the forward end thereof. The blade has a cable guide supported thereon for receiving a cable which is continuously fed into and along the bottom of a ground slit formed by the blade. The blade is fixedly supported to a shaker frame having a power driven oscillating mechanism supported thereon for reciprocating the blade vertically between upper and lower limits. The blade, shaker frame, and oscillating mechanism are suspended and adjustably secured to a swing frame on a prime mover, such as a conventional tractor.

The swing and shaker frames are interconnected adjacent the upper ends thereof by a pair of opposed connecting links. The lower ends of the swing frame and shaker frame are interconnected by a generally rectangular shaped, tempered, spring plate. The spring plate withstands the loading imposed upon it by the shaker frame and plow blade while being flexible to deflect vertically thereby permitting the vibratory motion from the oscillating mechanism to be transmitted to the plow blade. Thus, the spring plate provides suspension for the entire shaker assembly including the shaker frame, oscillating mechanism, and plow blade.

In operation, the swing frame and tractor act as a stationary support or restraint for one end of the spring plate during the vertical vibratory movement of the shaker frame on the opposite, unrestrained end of the spring plate. The shaker frame sits on the cantilevered, unrestrained end of the spring plate and the vibrational movement imparted to the shaker frame by the oscillating mechanism is also transmitted to the spring plate. This results in a reinforcement or prolongation of the vibratory movement imparted to the plow blade because the spring plate resonates or undulates thereby increasing the efficiency, duration and movement of the plow blade vibratory cutting action. The amplitude of the resonance or undulation created within the spring plate may be adjusted by forming recesses in the opposite ends of the plate to adjust the amplitude of the oscillating motion.

Thus, the present invention provides for the elimination of the elastic torque cushioning elements that have heretofore formed the connection between the opposite ends of the links between the shaker frame and swing frame thereby providing a relatively simple and inexpensive construction. Further, the spring plate accentuates the vibratory reciprocal motion of the shaker frame thereby providing for increased efficiency, duration and movement of the plow blade cutting action.

Other advantages and meritorious features of the vibratory cable plow suspension of the present invention will be more fully understood from the following description of the preferred embodiment, the appended claims, and the drawing, a brief description of which follows.

BRIEF DESCRIPTION OF DRAWING

FIG. 1 is a side elevational view of a tractor and vibratory cable laying plow having the suspension system of the present invention.

FIG. 2 is a side elevational view of the vibratory cable plow suspension.

FIG. 3 is a perspective view of the spring plate.

FIG. 4 is a perspective view of the spring plate with recesses in its opposite ends to adjust the amplitude of oscillating motion.

DETAILED DESCRIPTION OF THE INVENTION

Referring to FIG. 1, a cable laying implement 10 is shown supported on a tractor 12. The underground cable laying implement 10 includes a flat, elongated blade 14 having a vertical ground slitting edge at the forward end thereof. Blade 14 has a cable guide 16 supported thereon for receiving a cable (not shown) which is continuously fed into and along the bottom of the ground slit formed by blade 14, as is conventional.

The upper end of blade 14 is fixedly supported to a generally C-shaped shaker frame 18 by pins 20. Shaker frame 18 has a power driven oscillating mechanism 22 supported thereon for reciprocating blade 14 vertically between upper and lower limits. Blade 14, cable guide 16, shaker frame 18 and oscillating mechanism 22 are suspended and adjustably secured to a swing frame 24 on tractor 12.

The vertically extending swing and shaker frames 18 and 24 are interconnected adjacent the upper ends thereof by a pair of opposed connecting links 26. Each link 26 has one end supported on swing frame 24 by pivot pin 28 and an opposite end supported on shaker frame 18 by pivot pin 30.

The lower ends of the swing frame 24 and shaker frame 18 are interconnected by spring plate 32 which is attached to frames 24 and 18 by fastening members 34 that pass through openings 36 adjacent the corners of plate 32. Referring to FIG. 3, spring plate 32 is generally rectangular in shape and is tempered such that it will withstand the loading imposed upon it by the shaker frame 18 and plow blade 14 while being flexible to deflect vertically thereby permitting the vibratory motion from oscillating mechanism 22 to be transmitted to plow blade 14. Thus, plate 32 provides a spring suspension for the entire shaker assembly including frame 18, oscillating mechanism 22 and plow blade 14.

In operation, frame 24 acts as a stationary support or restraint for one end of the spring plate 32 during the vertical vibratory movement of shaker frame 18 on the opposite unrestrained end of plate 32. Shaker frame 18 sits on the cantilevered, unrestrained end of spring plate 32 and the vibrational movement imparted to shaker frame 18 by oscillating mechanism 22 is also transmitted to spring plate 32. This results in a reinforcement or prolongation of the vibratory movement imparted to plow blade 14 because spring plate 32 resonates or undulates thereby increasing the efficiency, movement and duration of the plow blade vibratory cutting action. Referring to FIG. 4, the amplitude of the resonance or undulation created within spring plate 32 may be adjusted by forming recesses 38 in the opposite ends of plate 32 to adjust the amplitude of the oscillating motion.

Thus, the present invention provides for the elimination of the elastic torque cushioning elements that have heretofore formed the connection between the opposite ends of the links between shaker frame 18 and swing frame 24 thereby providing a relatively simple and inexpensive construction. Further, the spring plate 32 accentuates the vibratory reciprocal motion of shaker frame 18 thereby providing for increased efficiency, movement and duration of the plow blade cutting action.

It will be apparent to those skilled in the art that the foregoing disclosure is exemplary in nature, rather than limiting, the invention being limited only by the appended claims.

I claim:

1. A plow assembly for laying an elongated flexible element such as a cable in the slot cut by the plow in the ground, comprising:

a vertically extending support frame adapted to be connected to a vehicle, a vertically extending generally C-shaped shaker frame having an elongated plow blade attached thereto and an oscillating mechanism supported on said shaker frame for vertically reciprocating said shaker frame and plow blade, said support frame being spaced from and generally parallel to said shaker frame, means for suspending said generally C-shaped shaker frame from said support frame, said suspending means consisting of links connecting the upper end of said shaker frame to the upper end of said support frame with each link being pivotally attached at one end to said shaker frame and pivotally attached at its opposite end to said support frame, said suspending means further consisting of a generally planar, horizontally disposed, spring plate member which interconnects the lower end of said shaker frame to the lower end of said support frame, and said spring plate member being fixedly attached at one end to the bottom of said support frame and being secured at its other end to the bottom of said generally C-shaped shaker frame whereby said support frame restrains one end of said spring plate member during vertical vibratory movement of said shaker frame on the opposite end of said plate member such that the vibrational movement imparted to said shaker frame by said oscillating mechanism being transmitted to said spring plate member for reinforcing or prolonging the vibratory movement imparted to said plow blade.

2. The plow assembly as defined in claim 1 wherein said spring plate member including recesses in its opposite ends for adjusting the amplitude of the vibratory movement imparted to said spring plate member.

* * * * *